United States Patent [19]

Thompson

[11] 4,408,364

[45] Oct. 11, 1983

[54] APPARATUS FOR WASHING AN ALOE VERA LEAF

[76] Inventor: Donnie Thompson, Rte. #2 Combes Rio Hondo Rd., Harlingen, Tex. 78550

[21] Appl. No.: 359,942

[22] Filed: Mar. 19, 1982

[51] Int. Cl.[3] ..... B08B 11/00; B08B 1/02

[52] U.S. Cl. ..... 15/21 D; 15/77

[58] Field of Search ..... 15/3, 3.17, 21 D, 60, 15/77, 102, 21 C; 198/405; 414/757, 758; 131/325

[56] References Cited

U.S. PATENT DOCUMENTS 2,933,746 4/1960 Frand ..... 15/77

3,292,194 12/1966 Randall ..... 15/77

*Primary Examiner*—Edward L. Roberts

*Attorney, Agent, or Firm*—Frank P. Cyr

[57] ABSTRACT

A washing apparatus designed particularly for washing both sides of an aloe vera leaf. The apparatus comprises a pair of endless conveyor belts, one such pair of conveyor belts adapted to travel first in a horizontal line of travel with a leaf placed thereon. The leaf on the endless conveyor is subjected to a spray of water and simultaneously to a brushing operation to clean one side of the leaf. Following the cleaning of the one side of the leaf, the endless conveyor belt is caused to travel from a horizontal line of travel to a vertical line of travel. When the conveyor belt is caused to travel on a vertical line of travel, the leaf thereon then assumes a position on the belt where the same will be inverted from an edgewise position and to then fall on a second conveyor belt travelling alongside, thus exposing the other side of the leaf. The leaf now travels on said second conveyor belt and the opposite side of the leaf is subjected to a spray of water and simultaneously to the action of a plurality of brushes to thus clean the other side of the leaf.

4 Claims, 6 Drawing Figures

APPARATUS FOR WASHING AN ALOE VERA LEAF

BACKGROUND OF THE INVENTION

The aloe vera leaf is derived from a plant which is found mostly in warm climates. Mostly the plant is found in sandy soils and while the leaf contains therein a gel which has been found to be very beneficial in the compounding of various products such as medicinal compositions, cosmetics, soaps, etc., the leaf prior to extracting the aforesaid gel therefrom must be thoroughly cleansed in order to avoid any impurities to co-mingle with the extracted gel. Thus, it is of utmost importance that the leaf be thoroughly cleansed before undertaking the removal of the gel from within the leaf.

With the above in mind, it is one object of the invention to provide an apparatus which will subject both sides of an aloe vera leaf to a thorough cleaning before the same is further processed to remove the gel from therewithin.

Another object of the invention is to provide an apparatus whereby first one side of a leaf is cleansed and thereafter the other side of the leaf is automatically subjected to a cleaning operation.

Another object of the invention is to provide an apparatus which will automatically clean first one side of the aloe vera leaf and then present the opposite side of the leaf to a cleansing operation.

Another object of the invention is to provide an apparatus which will automatically invert a leaf from a first conveyor belt to a second conveyor belt to thus present the opposite side of a leaf to a cleaning station.

Other objects and advantages of the present invention will be made more apparent as this description proceeds, particularly when considered in connection with the accompanying drawings.

DESCRIPTION OF THE PREFERRED EMBODIMENTS

Actually the leaf cleaned with the cleansing apparatus of the present invention is designed to be fed to a gel separator shown in my prior application for patent, Ser. No. 6/311,423, filed Oct. 14, 1981.

Figure 1:
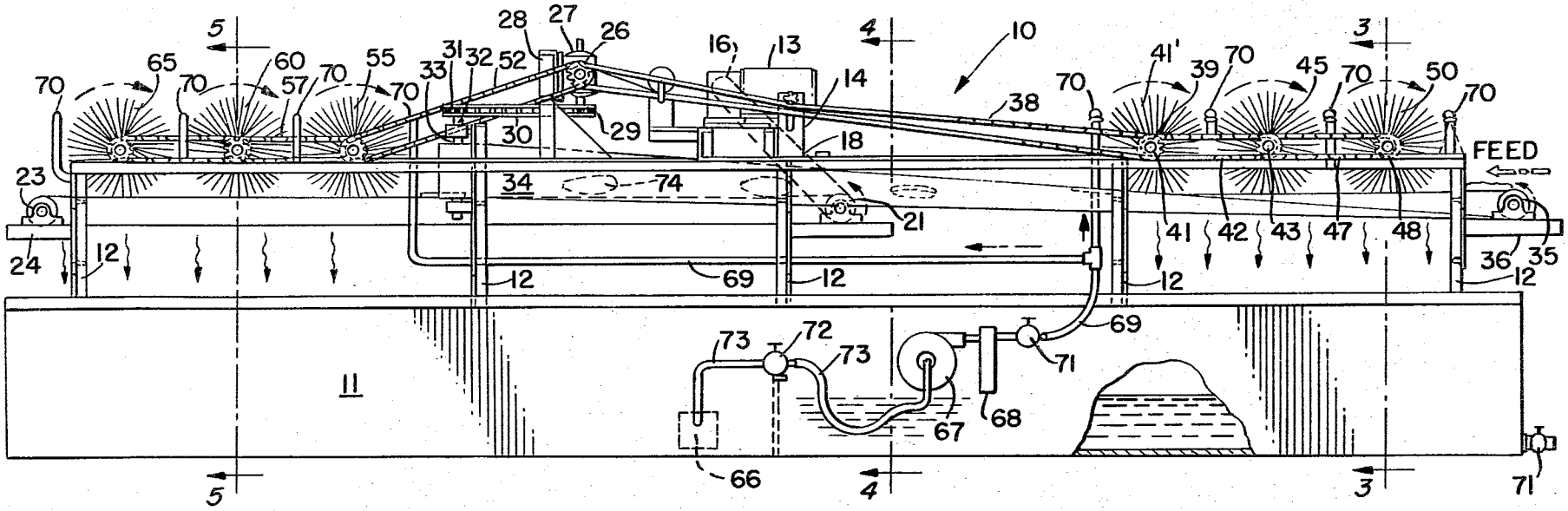
FIG. 1 is a perspective view of the washing apparatus of the present invention.
Figure 4:
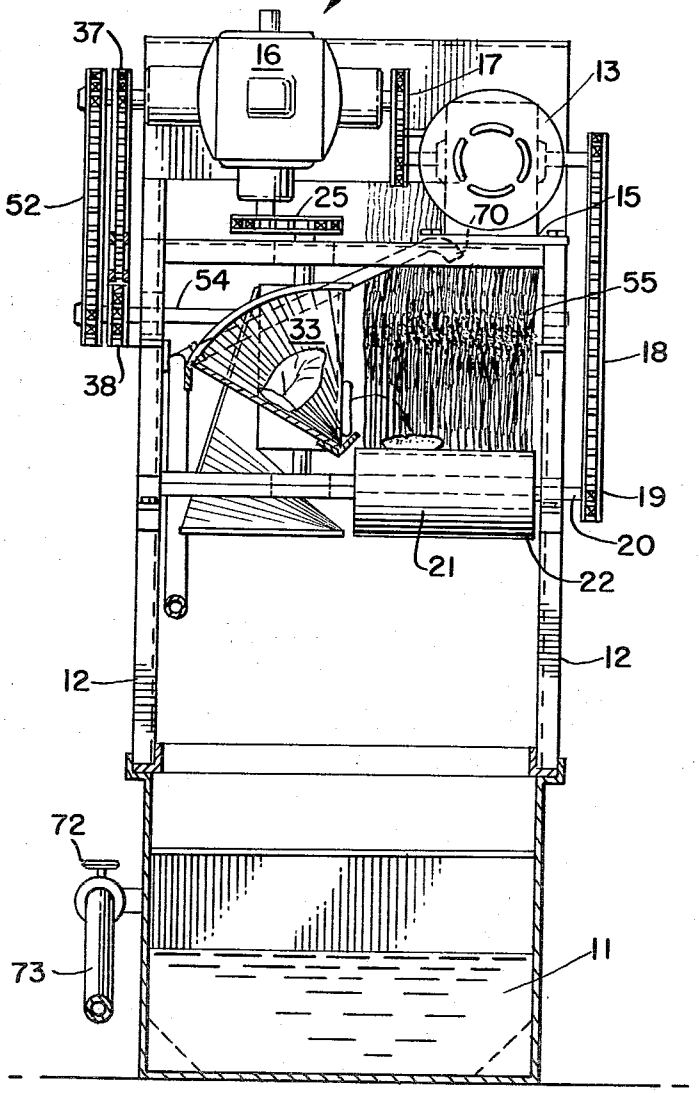
FIG. 4 is a section taken on lines 4—4 of FIG. 1, looking in the direction of the arrows.
Figure 3:
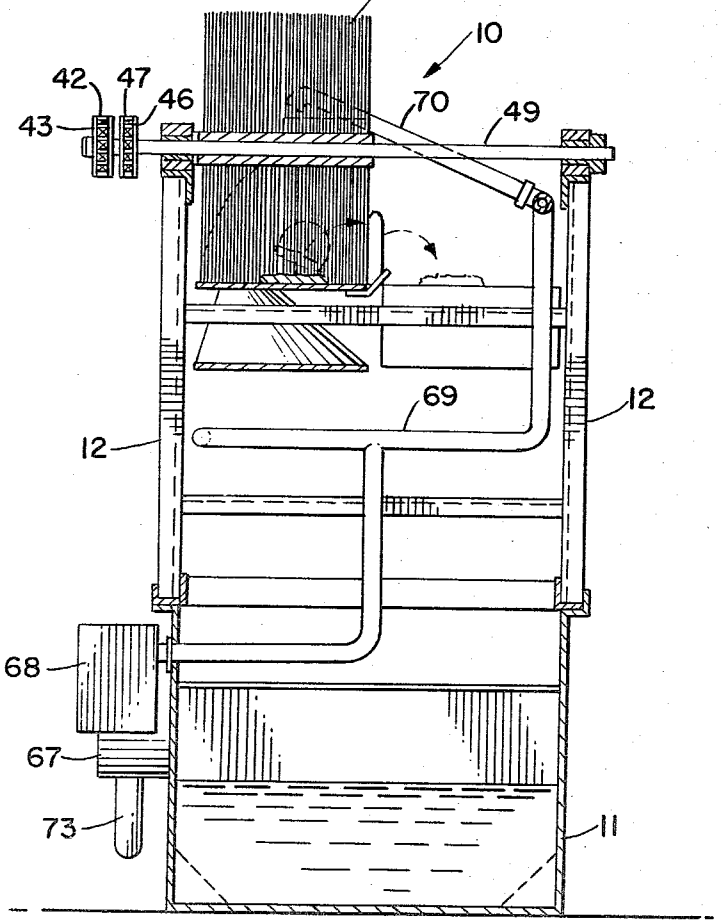
FIG. 3 is a section taken on lines 3—3 of FIG. 1, looking in the direction of the arrows.
Figure 5:
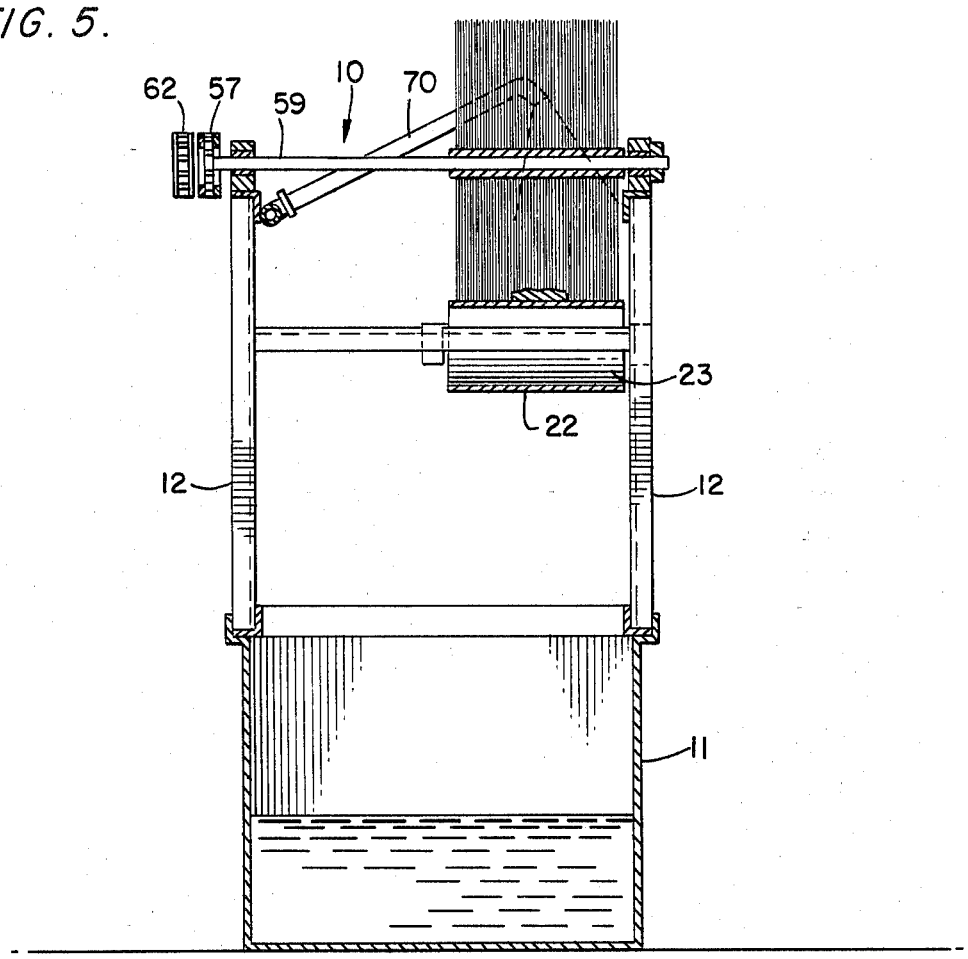
FIG. 5 is a section taken on lines 5—5 of FIG. 1, looking in the direction of the arrows.
Figure 6:
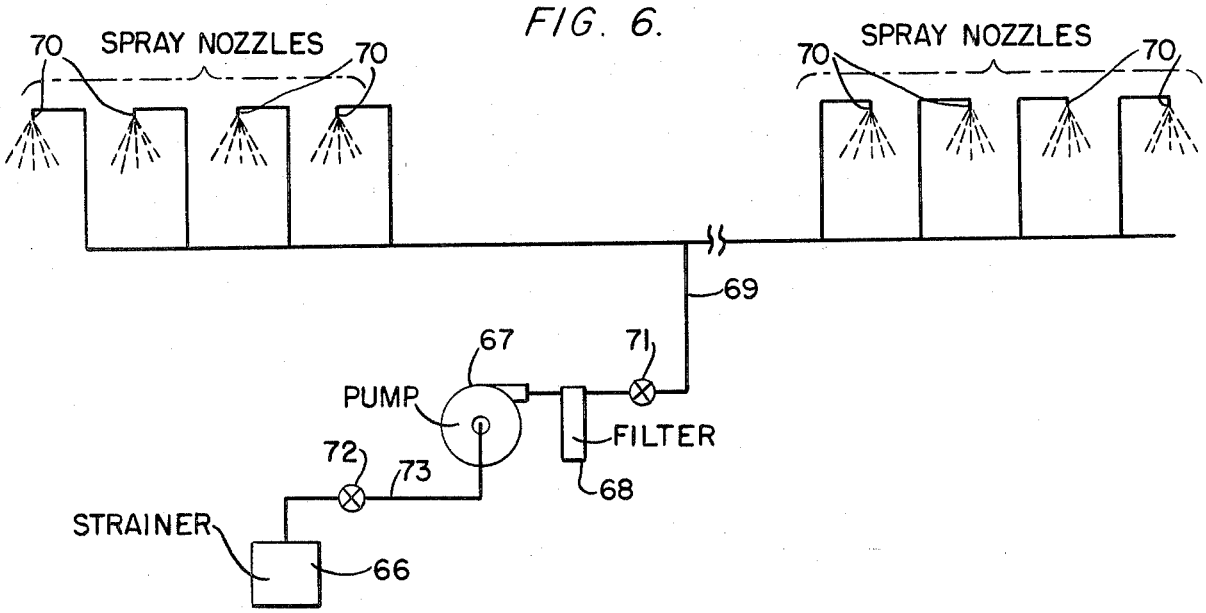
FIG. 6 is a schematic of the arrangement of the manner in which the cleaning liquid is supplied to the spray nozzles.

Referring now to the drawings wherein like reference numerals are employed to designate like parts throughout the several views, 10 designates in general, the washer apparatus of the present invention. The washer includes a tank 11 for the reception therein of a proper cleansing solution. The cleansing solution is caused to be returned to the tank 11 for recirculation following the use of the solution for cleaning a leaf in a manner to be more fully described hereinafter. The cleansing solution may be plain water or if desired, a detergent may be added thereto to enhance the cleaning of the leaf. The tank 11 is adapted to rest on a floor surface and is provided with a plurality of vertically extending standards 12 secured to the upper edge of the tank 11 in any known manner as by welding or the like. The vertical standards 12 are employed in supporting some of the components of the apparatus. A suitable motor 13 is mounted on one of the standards 12 and secured thereto by means of a bracket 14. A bracket 15, secured in any known manner to one of the standards 12 is employed for mounting a speed reducer 16. A chain drive 17 extends from the speed reducer to a transmission 27 as shown more clearly in FIG. 4 of the drawings. A chain drive 18 extends from motor 13 and is trained for travel over a sprocket gear 19 mounted on a shaft 20 which is keyed for rotation with a horizontally disposed roller 21 over which is mounted an endless conveyor belt 22. As best seen in FIGS. 1 and 4 of the drawings, the belt 22 is designed to travel over an idler roller 23 and it will be observed belt 22 is positioned along one side of the receiving tank 11. Idler roller 23 is mounted on the framework of the washer apparatus as by a bracket 24.

Extending from the speed reducer 16 is a chain drive 25 which is trained to travel over a gear 26 which is mounted for rotation on the transmission 27 which is secured to the framework by means of a standard 28. A gear 29 extends from the transmission 27 and a chain drive 30 extends therefrom to a gear 31 mounted for rotation with a shaft 32 which is keyed for rotation with a vertically extending roller 33, over which is trained for travel an endless belt member 34. Belt 34 extends between the aforesaid vertically disposed roller 33 and a horizontally disposed idler roller 35 mounted on a suitable base 36 at the feed-in end of the washer apparatus.

It will be noted in FIG. 2 that belt 34 is designed to travel on a path which is on the opposite side of the tank 11 as compared to the endless conveyor 22 for a purpose to be set forth more particularly hereinafter.

Figure 2:
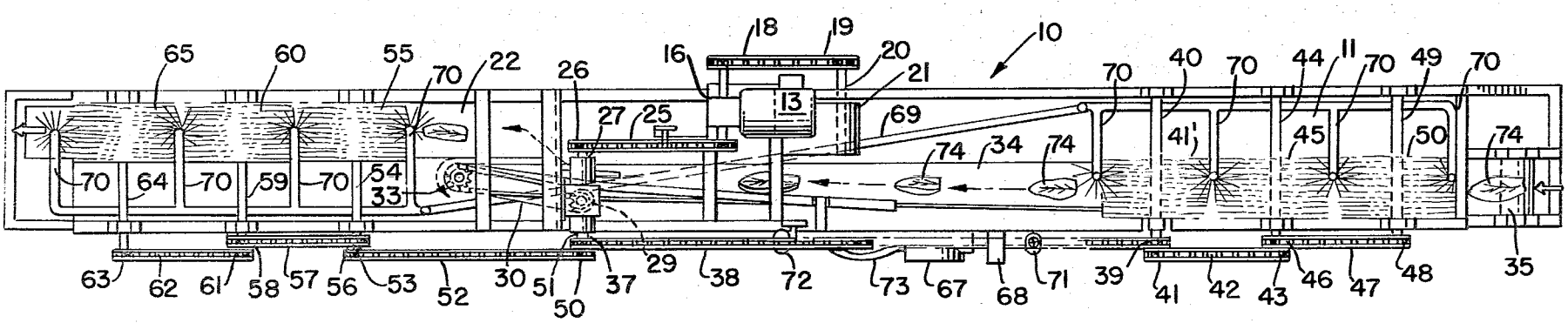
FIG. 2 is a top plan view of the washing apparatus of the present invention.

Referring now to FIG. 2 of the drawings, there is shown a gear 37 extending from transmission 27 and a sprocket chain 38 is trained for travel with said gear to a gear 39, which is keyed on shaft 40 for rotation therewith. A bushing element 41' is keyed for rotation with said shaft 40. Also mounted for rotation on shaft 40 is a gear 41 splined to the shaft 40 and a drive chain 42 extends between said gear 41 and a gear 43 splined for rotation with a shaft 44 on which is mounted a brushing element 45. A gear 46 is also keyed for rotation with shaft 44, and a sprocket chain 47 extends between said gear 46 and a gear 48 splined for rotation with a shaft 49 on which is mounted a brushing element 50. Thus, as can be seen, rotation to the aforesaid brushes is imparted by the driving power derived from the transmission 27. A like chain drive for a second set of brushes is shown more particularly in FIGS 1 and 2 of the drawings. Extending from the transmission 27 and mounted on a suitable shaft 51 extending therefrom is a gear 50 over which is trained for travel a chain drive 52 which has the other end thereof trained for travel with a gear 50 splined for rotation with a shaft 54 which has mounted thereon a rotating brushing element 55. Also mounted on shaft 54 is a second gear element 56 which is keyed for rotation with said shaft. A drive chain 57 extends from gear 56 and is in driving connection with a gear 58 keyed to shaft 59 on which is mounted a brushing element 60. Secured to shaft 59 is a gear 61 and trained for travel with said gear 61 is a drive chain 62 which is also mounted on a gear 63 keyed for rotation with a shaft 64 on which is mounted a rotating brushing element 65. Thus, with power derived from the aforesaid motor and through the transmission 27, motion is imparted to the brushes which are caused to rotate in a clockwise direction of travel over the leaf which has been placed on the first endless belt 34 at the entrance end of the washing apparatus.

The cleansing solution contained within tank 11 may be plain water or if desired, a suitable detergent may be added thereto to enhance the cleansing quality of the water.

Mounted within tank 11 is a strainer 66 of known construction to thereby filter the cleaner solution which is to be fed to the washer in a manner to be described hereinafter. A pump 67 of known construction is mounted in any known manner to the side of the tank 11 and a filter element 68 is positioned downflow of the pump 67 to further filter the cleansing solution before the same is fed to a plurality of sprayheads 70 through a conduit 69 which is connected to said filter 68. A manually operated valve 71 is mounted in conduit 69 to thus regulate the amount of cleanser solution fed to the aforesaid sprayheads 70. An outlet 71 is provided in the tank 11 so as to enable the tank to be drained when necessary to remove from therein any impurities in the cleaning solution.

A hand operated valve 72 is interposed in the conduit 73 extending from the strainer 66 and the pump 67 so as to enable one to regulate the amount of flow from within the container to the pump 67.

As shown more clearly in FIG. 2 of the drawings, the endless conveyor 34 and brushing elements are arranged for movement along one side of the washing apparatus whereas the other endless conveyor 22 is trained to travel on the opposite side of the washing apparatus. This will enable the leaf to be cleaned to travel first in one direction with one side thereof being cleaned and upon reaching a point approximately midway the washing apparatus, the leaf is caused to be inverted and to thus present the opposite side of the leaf to a cleansing operation by the brushing elements and sprayheads aforesaid.

Operation of the washer is as follows:

A leaf shown schematically at 74 is placed flat on the conveyor belt 34 at the entrance or feed end of the washer and the same is caused to travel on the conveyor in the direction shown in the arrows as in FIG. 1 of the drawings. As the leaf travels on the conveyor, the brushes 41', 45 and 50 will be caused to rotate in the direction of the arrows, FIG. 1 of the drawings. Simultaneously with the rotation of the aforesaid brushes, the cleaning fluid from the tank will be directed to the sprayheads 70 to thus deliver a stream of cleanser adjacent the said brushes to thus effect the cleaning of one side of the leaf. As the conveyor travels the belt is caused to gradually twist with one edge of the belt remaining level with the original line of travel whereas the opposite edge of the belt gradually rising so that when the belt reaches the vertically extending roller 33, the leaf will now assume a vertical position and is permitted to fall on to the endless conveyor 22 positioned along the side of the conveyor 34. The leaf thus deposited on the belt 22 will have been inverted to thus present the opposite side of the leaf to be subject to a cleansing operation such as previously described. The brush bristles are specially designed to effect a proper brushing of both sides of the leaf and are stiff enough to scrub the dirt off the leaf yet not so stiff as to impede the travel of the leaf through the washing apparatus. The cleansing solution is caused to fall into the receiving tank for recirculation following the cleaning of the leaf.

From the foregoing, it will be readily seen that I have provided an efficient method and apparatus for cleaning both sides of an aloe vera plant leaf prior to subjecting the leaf to an apparatus which will effectively remove the gel from therewithin. I am aware that numerous details of construction may be varied throughout a wide range without departing from the principles disclosed herein and I therefore do not propose limiting the patent granted hereon otherwise than as necessitated by the appended claims.

I claim:

1. An apparatus for cleaning both sides of an aloe vera leaf comprising a pair of endless conveyors for supporting the leaf thereon while travelling from the entrance to the exit end of the apparatus, one of said pair of conveyors travelling in a horizontal line of travel between a horizontally disposed roller and a vertically disposed roller so as to cause said conveyor to twist in it's travel between said rollers to thereby extend in a vertical position causing said leaf to be inverted and deposited on a second endless conveyor, said leaf travelling on said pair of endless conveyors subjected to a scrubbing action by roller brushes extending over the said pair of conveyors and simultaneously applying a cleaning solution to the said leaf through suitable sprayheads mounted on said apparatus.

2. The structure recited in claim 1 wherein one of said pair of endless conveyors extends along one side of a liquid receiving tank positioned therebelow and the other of said pair of endless conveyors extends along the opposite side of said liquid receiving tank.

3. The structure recited in claim 1 wherein a transmission is employed to effect the simultaneous rotation of all of said roller brushes and wherein a spray of a cleaning liquid is fed to a position adjacent the said brushes.

4. The structure recited in claim 1 wherein said pairs of endless conveyors and rotating brushes are mounted on a plurality of supports extending over a liquid receiving tank and the cleaning solution applied to the said leaf is returned to the said liquid receiving tank for cleaning and recirculation through the aforesaid sprayheads.

* * * * *